US010832875B2

(12) United States Patent
Johnson

(10) Patent No.: US 10,832,875 B2
(45) Date of Patent: Nov. 10, 2020

(54) BARRIER USABLE WITH ELECTRICAL INTERRUPTION DEVICE AND STRUCTURED TO RESIST THE INSERTION OF PROBE HAVING KNOWN DIMENSIONS

(71) Applicant: EATON CORPORATION, Cleveland, OH (US)

(72) Inventor: Jeffrey Lee Johnson, Lincoln, IL (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 399 days.

(21) Appl. No.: 15/140,539

(22) Filed: Apr. 28, 2016

(65) Prior Publication Data

US 2017/0316893 A1 Nov. 2, 2017

(51) Int. Cl.
*H01H 9/02* (2006.01)
*H01H 9/52* (2006.01)

(52) U.S. Cl.
CPC ..... *H01H 9/0264* (2013.01); *H01H 9/52* (2013.01)

(58) Field of Classification Search
CPC ..... H01H 9/0264; H01H 9/52
See application file for complete search history.

(56) References Cited

U.S. PATENT DOCUMENTS 6,930,577 B2 * 8/2005 Subramanian ..... H01H 9/0264 200/304
6,942,527 B1 * 9/2005 Lias ..... H01R 4/38 335/202
7,009,126 B2 * 3/2006 Etscheidt ..... H01H 9/0264 200/293
7,132,913 B2 * 11/2006 Whipple ..... H01H 11/0031 335/202
7,619,902 B2 * 11/2009 Buchbender ..... H01H 11/0031 174/59
9,343,245 B2 * 5/2016 Oh ..... H01H 9/0264

* cited by examiner

*Primary Examiner* — Felix O Figueroa
(74) *Attorney, Agent, or Firm* — Eckert Seamans Cherin & Mellott, LLC

(57) ABSTRACT

A barrier includes a cover and an attachment apparatus and is usable with an electrical interruption device. The attachment apparatus includes a number of attachment structures that are situated on the cover and that are each structured to be engaged with at least one of the housing of the electrical interruption device and a number of terminal assemblies of the electrical interruption device. The cover is configured to overlie at least a portion of the electrical interruption device and to resist the entry of a probe of known dimensions into electrical contact with components that are electrified even when the electrical interruption device is in an OFF condition.

12 Claims, 12 Drawing Sheets

BARRIER USABLE WITH ELECTRICAL INTERRUPTION DEVICE AND STRUCTURED TO RESIST THE INSERTION OF PROBE HAVING KNOWN DIMENSIONS

BACKGROUND

Field

The disclosed and claimed concept relates generally to electrical interruption equipment and, more particularly, to a barrier that is usable in conjunction with an electrical interruption device and that is configured to resist the insertion of an elongated probe having known dimensions into electrified portions of the interruption device.

Related Art

Numerous types of electrical interruption devices and related equipment are known in the relevant art. Underwriters Laboratories has initiated a new requirement in their UL 67 Standard. Specifically, the standard requires that a barrier or shield be included in products that include service entrance circuit breakers. The barrier is to shield installers or homeowners from incidental contact with electrified or "live" parts by covering those areas that remain live when the breaker is in the OFF condition. A probe (such as is depicted in FIG. 3A) has known dimensions and is approved under the UL 67 Standard to be used in determining whether an installed barrier complies with the UL 67 Standard. The probe is used by field inspectors to verify that gaps and spacings are compliant with the UL 67 Standard and resists incidental contact with live components once the barrier is installed.

However, difficulties exist in the configuration of any such barrier. For instance, heat can be generated in electrical equipment, and it would be desirable to avoid excess heat buildup when such a barrier is used. Additionally, various attachment methodologies must be accommodated, and a range of line conductor diameters must also be accommodated. Such a barrier desirably would also be easy to install and remove. Thus a number of problems exist with the development of a barrier that will meet the requirements of the UL 67 Standard.

SUMMARY

Advantageously, therefore, an improved barrier in accordance with the disclosed and claimed concept includes a cover and an attachment apparatus and is usable with an electrical interruption device. The attachment apparatus includes a number of attachment structures that are situated on the cover and that are each structured to be engaged with at least one of the housing of the electrical interruption device and a number of terminal assemblies of the electrical interruption device. As employed herein, the expression "a number of" and variations thereof shall refer broadly to any non-zero quantity, including a quantity of one. The cover is configured to overlie at least a portion of the electrical interruption device and to resist the entry of a probe of known dimensions into electrical contact with components that are electrified even when the electrical interruption device is in an OFF condition.

Accordingly, an aspect of the disclosed and claimed concept is to provide an improved barrier that is usable with an electrical interruption device and which is configured to resist the entry of a probe of known dimensions.

Another aspect of the disclosed and claimed concept is to provide an improved barrier that is easy to install on an electrical interruption device and to remove therefrom.

Another aspect of the disclosed and claimed concept is to provide such an improved barrier that permits ventilation of heat from electrical resistance.

As such, an aspect of the disclosed and claimed concept is to provide an improved barrier that is structured to be used with an electrical interruption device having a housing and further having a number of terminal assemblies that are situated on the housing, the number of terminal assemblies being electrically conductive and being electrically connected with a number of line conductors, the barrier being structured to resist access to the number of terminal assemblies by a probe of predetermined dimensions. The barrier can be generally stated as including a cover that can be generally stated as including a first cover portion and a second cover portion connected together, the cover being structured to limit access by the probe to the number of terminal assemblies, the first cover portion having a number of openings formed therein that are structured to receive therein the number of line conductors, the second cover portion being structured to overlie the number of terminal assemblies and having formed therein a number of access ports that are structured to receive therein a tool that is cooperable with the number of terminal assemblies to facilitate connection and disconnection of the number of line conductors, and an attachment apparatus comprising a number of attachment structures that are situated on the cover and that are each structured to be engaged with at least one of the housing and at least a first terminal assembly of the number of terminal assemblies to retain the barrier on the electrical interruption device.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 5:
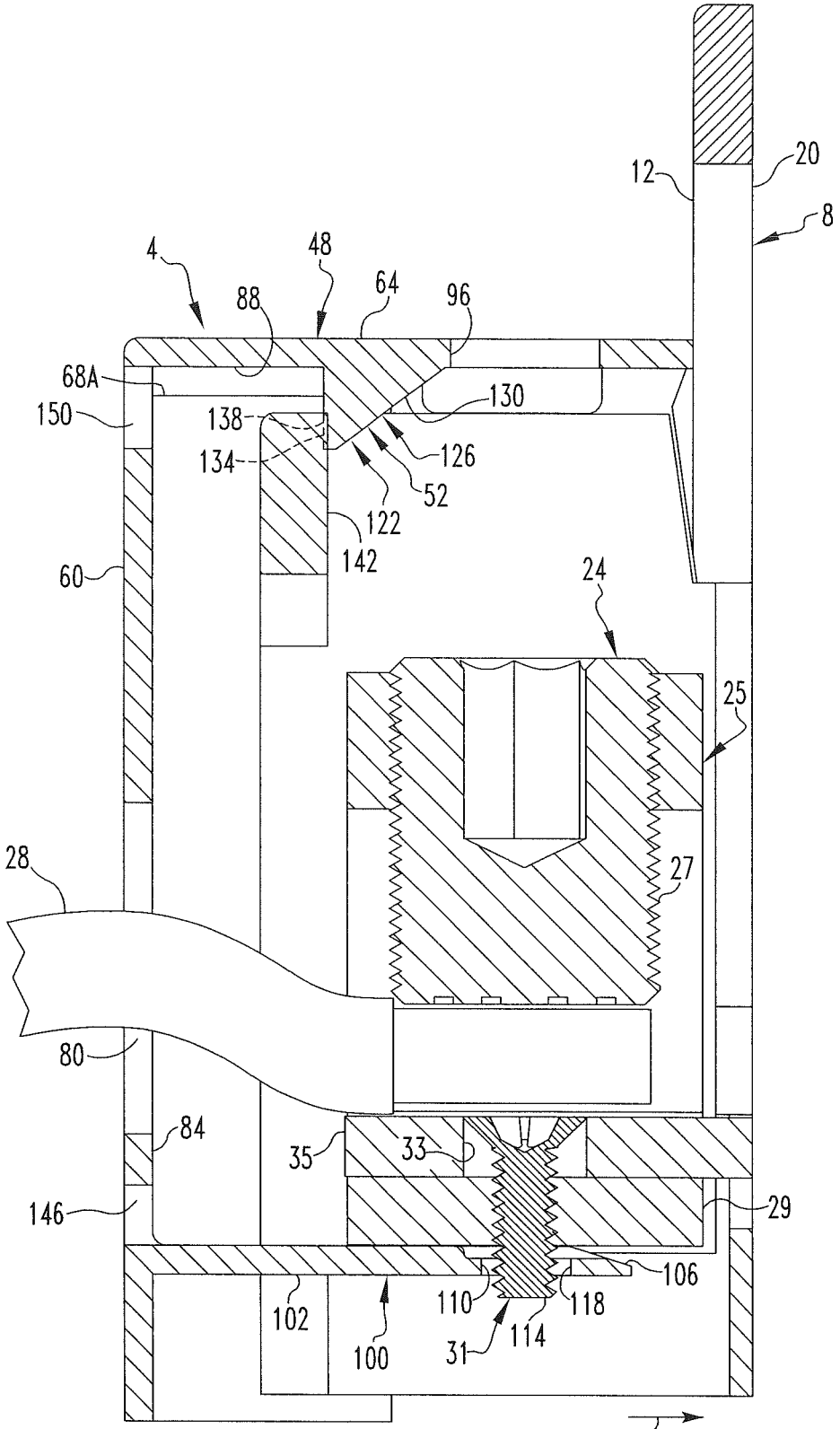
FIG. 5 is a sectional view as taken along line 5-5 of FIG. 4.

An improved barrier 4 in accordance with the first embodiment of the disclosed and claimed concept is depicted generally in FIGS. 1-3 and 4-5. The barrier 4 is usable in conjunction with an electrical interruption device 8 such as is depicted generally in FIGS. 3 and 4 and which can be said to include a line side 12 and a load side 16. The interruption device 8 has a housing 20 upon which are situated a plurality of terminal assemblies 24 that are electrically connectable with a set of line conductors 28 as are schematically depicted in FIG. 5. The terminal assemblies 24 can each be said to include a barrel screw 27 and a support 25 upon which the barrel screw 27 is threadably situated. The support 25 includes a base portion 29 and a fastener 31. The fastener 31 is received through a bore 33 fainted in an electrical bus 35 of the interruption device 8 and through a threaded hole formed in the base portion 29 to affix and to electrically connect the base portion 29 and thus the terminal assembly 24 to the interruption device 8.

The barrier 4 is advantageously provided for use in conjunction with the interruption device 8 in order to resist unintended incidental contact with electrified or live components of the interruption device 8 when the interruption device 8 is electrically connected with the line conductors 28 but when it is in an OFF condition. As noted above, Underwriters Laboratories has set forth a new requirement in its UL 67 Standard which includes a provision that a probe 32 such as is depicted generally in FIG. 3A and which has known dimensions is to be used by an inspector to verify gaps and spacings by seeking to insert the probe 32 in various fashions into contact with live components of the electrical interruption device 8. The probe 32 has a known probe length 36, a known probe width 40, and has a probe tip 44 having a known shape, dimensions, and tip contour.

Figure 1:
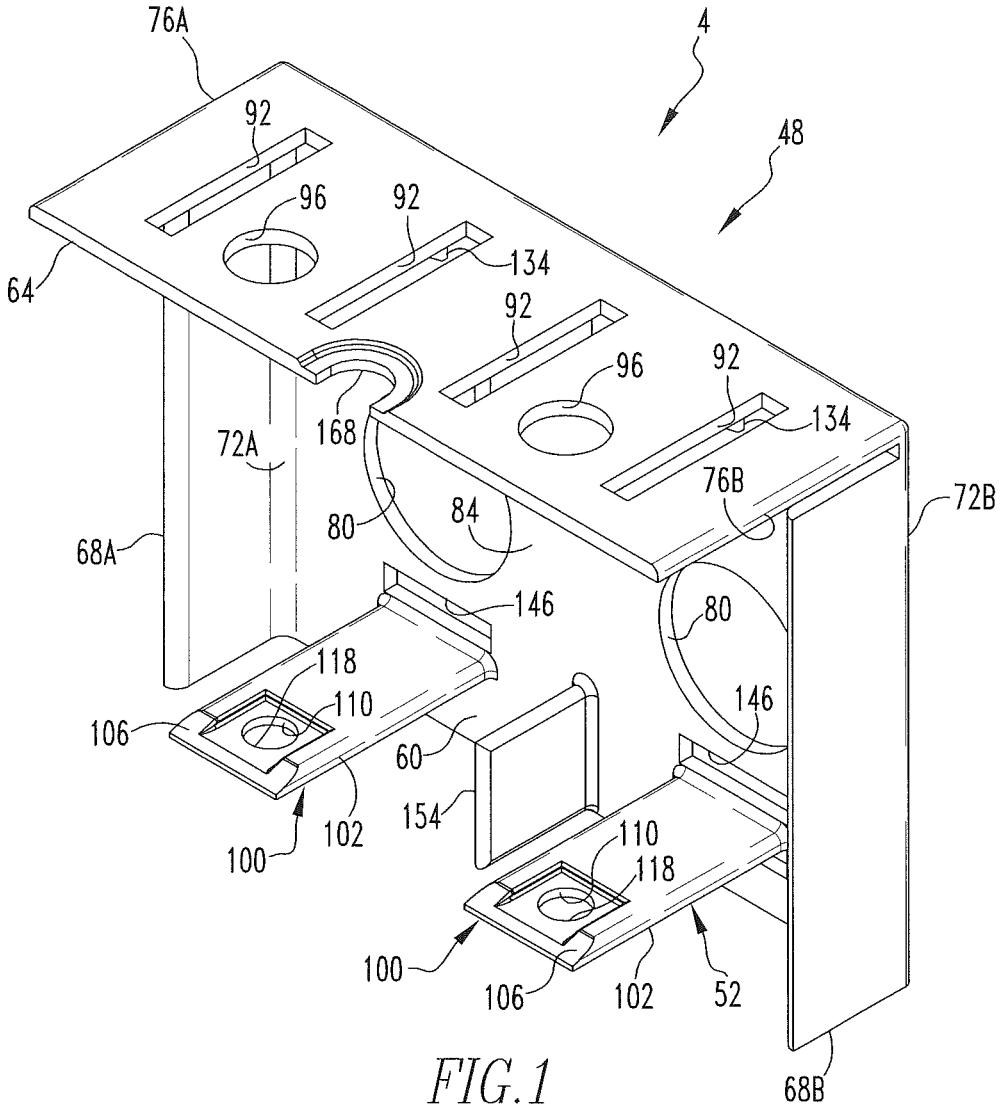
FIG. 1 is a perspective view of an improved barrier in accordance with a first embodiment of the disclosed and claimed concept.
Figure 2:
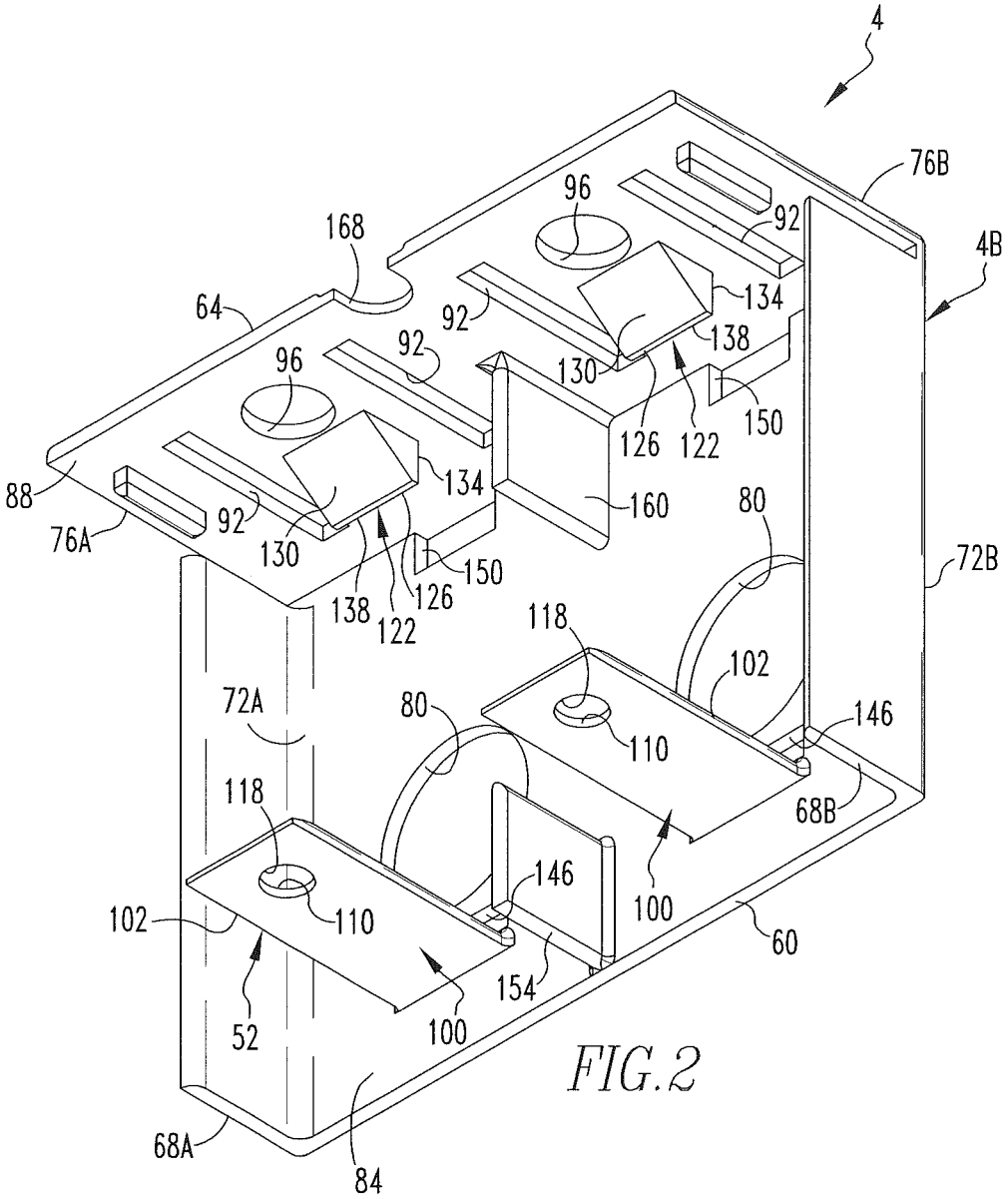
FIG. 2 is another perspective view of the first embodiment.
Figure 3:
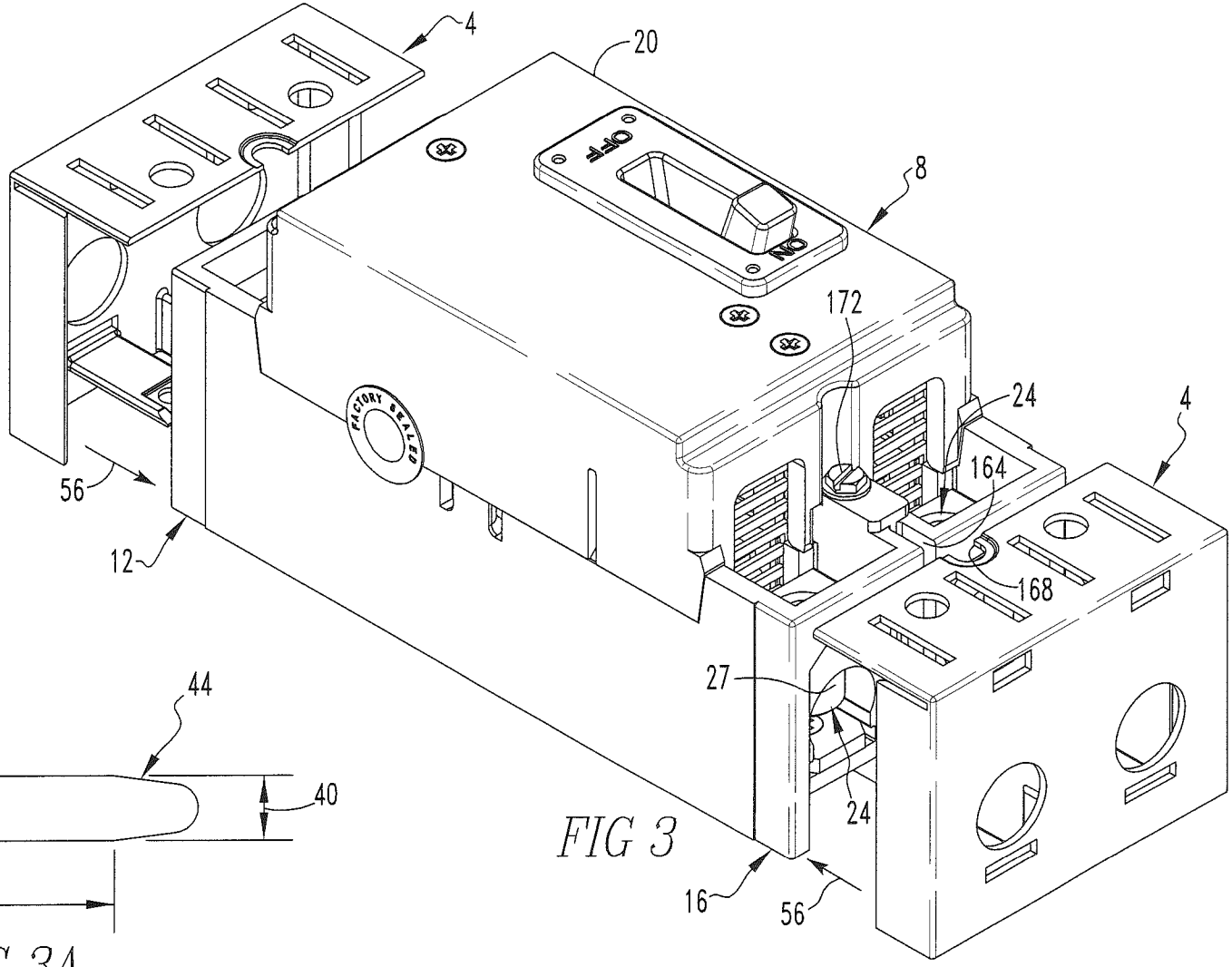
FIG. 3 is a perspective view depicting an electrical interruption device and a pair of the barriers in accordance with the first embodiment being received on the ends thereof.
Figure 3A:
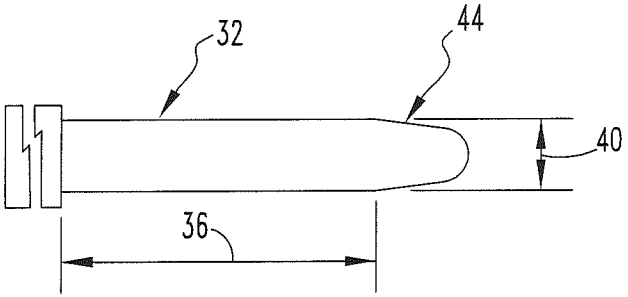
FIG. 3A is an exemplary depiction of a probe that is usable by a technician to verify gaps and spacings between the barrier of the first embodiment and the electrical interruption device.
Figure 4:
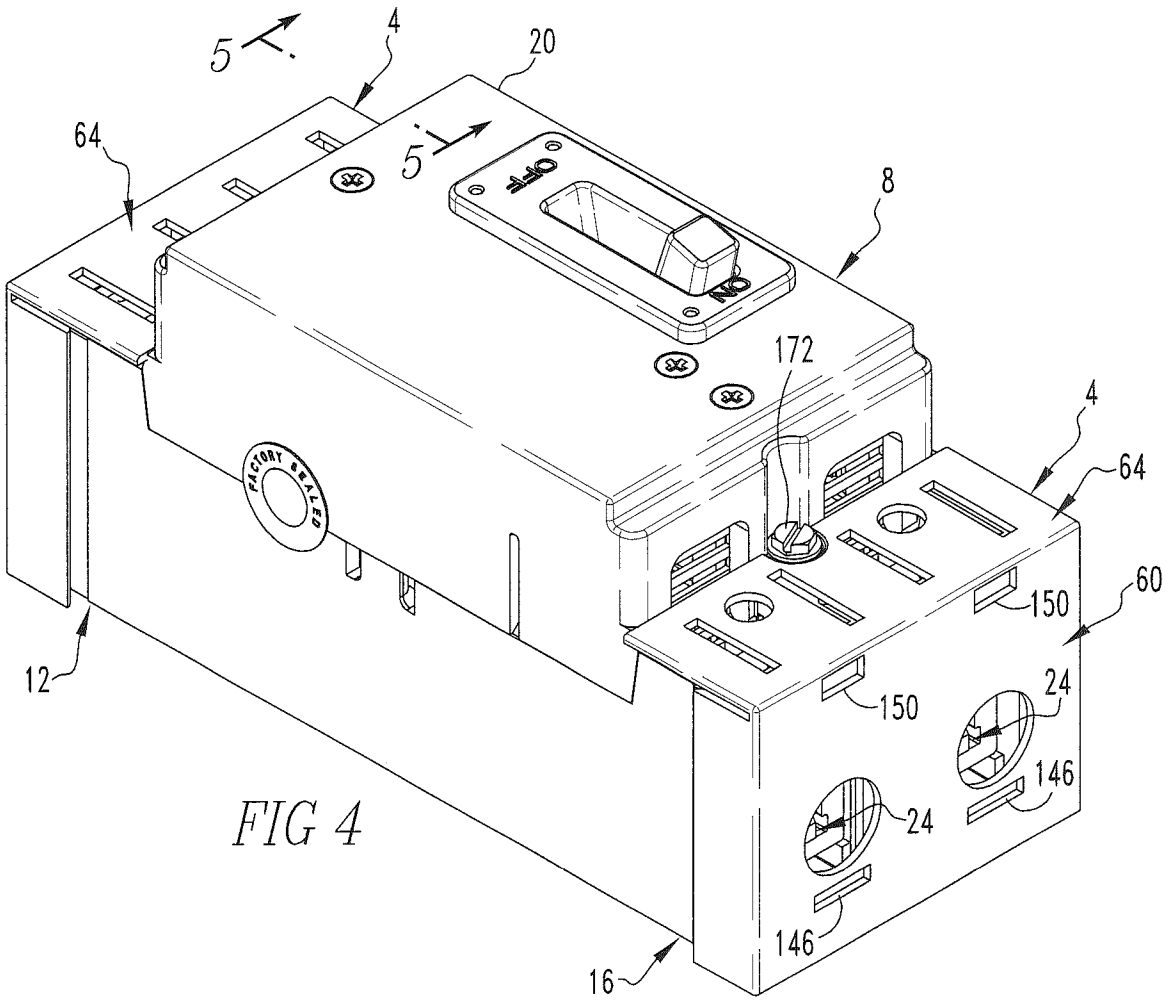
FIG. 4 is another perspective depiction of the electrical interruption device, except including two of the barriers of the first embodiment installed thereon.

As can be seen in FIGS. 1 and 2, the barrier 4 can be said to include a cover 48 and an attachment apparatus 52. The barrier 4 is receivable on the interruption device 8 by receiving it in a direction along an insertion direction arrow 56, two which are depicted in FIG. 3, and which depict an instance of the barrier 4 being received on each of the line end 12 and the load end 16 of the interruption device 8. The insertion direction arrows 56 can be said to be oriented approximately horizontally from the perspective of FIG. 3.

The cover 48 can be said to include a plate-like first cover portion 60, a plate-like second cover portion 64, and a pair of plate-like lateral cover portions 68A and 68B. The first and second cover portions 60 and 64 are connected together along a common edge, and the lateral cover portions 68A and 68B extend along and are connected with a pair of opposite edges 72A and 72B of the first cover portion 60. The lateral cover portions 68A and 68B extend along the edges 72A and 72B to a location near a pair of edges 76A and 76B of the second cover portion 64, but it is noted that the lateral cover portions 68A and 68B are spaced from and are disconnected from the edges 76A and 76B of the second cover portion 64. Such disconnection and discontinuity permits the second cover portion 64 to be elastically deformed in a fashion that will be set forth in greater detail below in order to permit the barrier 4 to be removed from the interruption device 8.

As can be understood from FIGS. 1 and 2, the first cover portion 60 has a pair of openings 80 fainted therein through which the line conductors 28 are received. The schematically-depicted openings 80 can be of any size that is appropriate to accommodate the line conductors 28, and it is understood that the openings 80 can be configured to include multiple-size knockouts and the like that are intended to accommodate line conductors 28 of particular sizes in order to resist the reception of the probe 32 in the openings 80 when the line conductors 28 are received therein. Alternatively, snap bushings could be received in the openings 80, and such snap bushings could be configured to have split regions that would enable it to receive therein various sized conductors while still resisting the reception of the probe 32 in the openings 80 when the line conductors 28 are received therein. The cover 48 has a first interior surface 84 on the first cover portion 60 and further includes a second interior surface 88 on the second cover portion 64. The first and second interior surfaces 84 and 88 face generally toward the interruption device 8.

The second cover portion 64 has a set of ventilation apertures 92 formed therein that permit convective heat flow therethrough to thereby avoid the buildup of heat between the barrier 4 and the interruption device 8. The second cover portion 64 further has a pair of access ports 96 formed therein through which an appropriate tool, such as a hex wrench or other appropriate tool, can be received to operate the terminal assemblies 24 in a fashion that permits connection and disconnection of the line conductors 28 with the terminal assemblies 24. The probe lengths 36 is insufficient to permit the probe 32, when received in the access ports 96, to physically contact the terminal assemblies 24.

The attachment apparatus 52 can be said to include a pair of first attachment structures 100 that are situated on the first cover portion 60 and a pair of second attachment structures 122 that are situated on the second cover portion 64. The first and second attachment structures 100 and 122 are connectable with the interruption device 8 in order to retain the barrier 4 on the interruption device 8.

In particular, the first attachment structures 100 each include an elongated tab 102 that extends from the first interior surface 84 and which has a first ramped insertion surface 106 formed thereon at a location spaced from the first interior surface 84 and disposed generally at the free end of the corresponding tab 102. The tabs 102 each further have a hole 110 formed therein adjacent the first ramped insertion surface 106 and which is configured to receive therein a portion of a threaded shank 114 of the fastener 31 of one of the terminal assemblies 24. The first attachment structures 100 each can be said to include a first retainer 118, which is an edge of the hole 120 that is disposed adjacent the first ramped insertion surface 106 and which is engageable with the threaded shank 114 to resist removal of the barrier 4 from the interruption device 8.

The second attachment structures 122 each are in the form of an approximately wedge-shaped abutment 126 that protrudes from the second interior surface 88 and which includes a second ramped insertion surface 130 and a second retainer 134 that is situated adjacent the second ramped insertion surface 130. The second retainer 134 of each second attachment structure 122 is in the form of a flat ledge 138 which, as can be understood from FIG. 5, is engageable with a wall 142 of the housing 20 to resist removal of the barrier 4 from the interruption device 8.

More specifically, and as can be understood from FIG. 5, when the barrier 4 is received as indicated by the insertion direction arrow 56 of FIG. 3 and is received on the line side 12 of the interruption device 8, the first ramped surface 106 engages the threaded shank 114 and causes the tab 102 to elastically deflect until, with continued advancement of the barrier along the direction of the insertion arrow 56 toward the interruption device 8, the threading shank 114 is received in the hole 110. Approximately simultaneously therewith, the second ramped insertion surface 130 engages the wall 142 of the housing 20 and elastically deforms the second cover portion 64 in a direction generally away from the first attachment structure 100 in order to cause the abutment 126 to clear the wall 142 and elastically return to the condition depicted generally in FIG. 5, whereupon the ledge 138 engages the wall 142. The elastic deformation of the tab 102 and the elastic deformation of the second cover portion 64 that occur upon such insertion of the barrier 4 are in directions generally away from one another and thus are in opposite directions. As can be understood from FIG. 5, the first and second ramped insertion surfaces 106 and 130 both face generally toward the housing 20 and face generally away from the first interior surface 84. As such, movement of the barrier 4 along the insertion direction arrow 56 causes such engagement between the first ramped insertion surface 106 and the threaded shank 114 and between the second ramped insertion surface 130 and the wall 142 to result in the first and second retainers 118 and 134 engaging the interruption device 8 and retaining the barrier 4 on the interruption device 8.

It is noted that the line conductors 28 could be received through the openings 80 prior to being attached to the terminal assemblies 24. That is, the line conductors 28, with the barrier 4 situated thereon due to the line conductors 28 being received in the openings 80, could be connected to the terminal assemblies 24 prior to reception of the barrier 4 on the interruption device 8. After such connection of the line conductors 28 with the terminal assemblies, the barrier 8 could be slid along the line conductors 28 in a direction toward the interruption device 8, which would be generally along the direction of the arrow 56, to cause the barrier 4 to be received on the interruption device 8 in the fashion set forth above.

As can be understood from FIGS. 1 and 2, as well as FIG. 5, the first cover portion 60 has a pair of first receptacles 146 formed therein adjacent the first attachment structures 100 and further has a pair of second receptacles 150 formed therein in the vicinity of the second attachment structures 122. The first and second receptacles 146 and 150 are configured to received therein a removal tool, such as a slot screwdriver or such tool, to permit disengagement of the first and second attachment structures 100 from the interruption device 8 to thus permit removal of the barrier 4 therefrom. Specifically, a removal tool received in one of the first receptacles 146 will permit the first attachment structure 100 to be elastically deformed in the downward direction from the perspective of FIG. 5 to permit the threaded shank 114 to be dislodged from the hole 110. This likely would be done to both of the first attachment structures 100, either simultaneously or successively. The removal tool received in the second receptacles 150 could similarly be employed to elastically deform the second cover portion 64 in a generally upward direction from the perspective of FIG. 5 to cause the second retainer 134 to clear the wall 142 and to permit the second attachment structures 122 to be disengaged from the wall 142. Again, this may be done either simultaneously for both of the second attachment structures 122, or could be done successively. As such, while the first and second ramped insertion surfaces 106 and 130 permit easy installation of the barrier 4 on the interruption device 8, the first and second receptacles 146 and 150 are configured to received therein an appropriate tool to permit easy removal of the barrier 4 from the interruption device 8. It is noted that the line conductors 28 need not necessarily be disconnected from the terminal assemblies 24 prior to removal of the barrier 4 from the interruption device 8.

The attachment apparatus 52 can be further said to include a first alignment structure 154 that is affixed to the first interior surface 84 and a second alignment structure 160 that is affixed to the second interior surface 88 and which are both receivable in a notch 164 formed in the housing 20. It can be understood from FIG. 2 that the second alignment structure 160 is situated adjacent the first cover portion 60 but is not connected therewith in order to avoid interfering with the elastic deformation of the second cover portion 64 with respect to the first cover portion 60, such as the elastic deformation that occurs during installation of the barrier 4 on the interruption device 4. The first and second alignment structures 154 and 160 received in the notch 164 provide alignment along an axis that extends into and out of the plane of the page of FIG. 5 in order to align the first and second attachment structures 100 and 122 with the interruption device 8 in the fashion set forth above.

As can be understood from FIGS. 1 and 2, the second cover portion 64 further has an indentation 168 formed therein in an edge opposite its connection with the first portion 60 and which is structured to receive therethrough a portion of a screw 172 that is threadably connectable with the housing 28 on the load side 16 of the interruption device 8. It is understood that the housing 20 may not include all of the structures with which the first and second attachment structures 100 and 122 would desirably engage, and the indentation 168 is provided in order to permit the screw 172 to provide a further securement for affixing the barrier 4 on the load side 16 of the interruption device 8. In this regard, it is understood that the application of a barrier 4 to the load side 16 is not required under UL 67, but it is something that a customer may find desirable depending upon the needs of the particular application, and the barrier 4 is thus configured to enable secure connection with the load side 16. It is also expressly noted that what is referred to herein as being the line side 12 and the load side 16 of the interruption device 8 are not intended to be limiting, and rather it is noted that whichever side of the interruption device 8 has the line conductors 28 connected therewith will become the line side of the interruption device 8.

An improved barrier 204 in accordance with a second embodiment of the disclosed and claimed concept is depicted generally in FIGS. 6-9. The barrier 204 is similar to the barrier 4 in that it includes a cover 248 and an attachment apparatus 252 that is attachable to the interruption device 8 in order to cause the cover 248 to overlie the line side 12 or the load side 16 or both thereof. However, the barrier 204 is configured differently than the barrier 4 because the attachment apparatus 252 is configured to enable the barrier 204 to be received on the interruption device 8 along another insertion direction arrow 256 which along an approximately vertical direction from the perspective of FIG. 8, and which is substantially perpendicular to the insertion direction arrows 56 of the barrier 4.

In a fashion similar to the barrier 4, the cover 248 includes a first cover portion 260, a second cover portion 264, and a pair of lateral cover portions 268A and 268A. In the barrier 204, however, the lateral cover portions 268A and 268B are affixed to the edges 272A and 272B of the first cover portion 260 as well as the edges 276A and 276B of the second cover portion 264.

The first cover portion 260 has a set of openings 280 formed therein for reception of the line conductors 28 and has a first interior surface 284 that faces generally toward the interruption device 8. The second cover portion 264 has a second interior surface 288 that faces generally toward the interruption device 8 and further includes an exterior surface 380 opposite the second interior surface 288. The second cover portion 264 has a number of ventilation apertures 292 and a number of access ports 296 formed therein for the same purposes as which they are provided on the barrier 4.

The attachment apparatus 252 includes a pair of first attachment structures 300 and a pair of second attachment structures 322 that are cooperable with the housing 20 to secure the cover 248 to the interruption device 8. More specifically, the first attachment structure 300 includes an elongated tab 302 that extends from the second interior surface 288 and that includes a first pair of ramped insertion surfaces 306A and 306B that are situated generally at the free end of the tab 302 and are disposed opposite its connection with the second interior surface 288. The first attachment structures 300 each further include a first retainer 318 which is in the exemplary form of a first pair of ledges 320A and 320B that are situated on the corresponding tab 302 adjacent the corresponding first pair of ramped insertion surfaces 306A and 306B.

The second attachment structures 322 are similar to the first attachment structures 300 in that they each include an elongated tab 326 that extends from the second interior surface 288, a second pair of ramped insertion surfaces 330A and 330B situated at the free end of the corresponding tab 326, and a second retainer 334 in the form of a second pair of ledges 338A and 338B that are situated adjacent the corresponding second pair of ramped insertion surfaces 330A and 330B.

Figure 9:
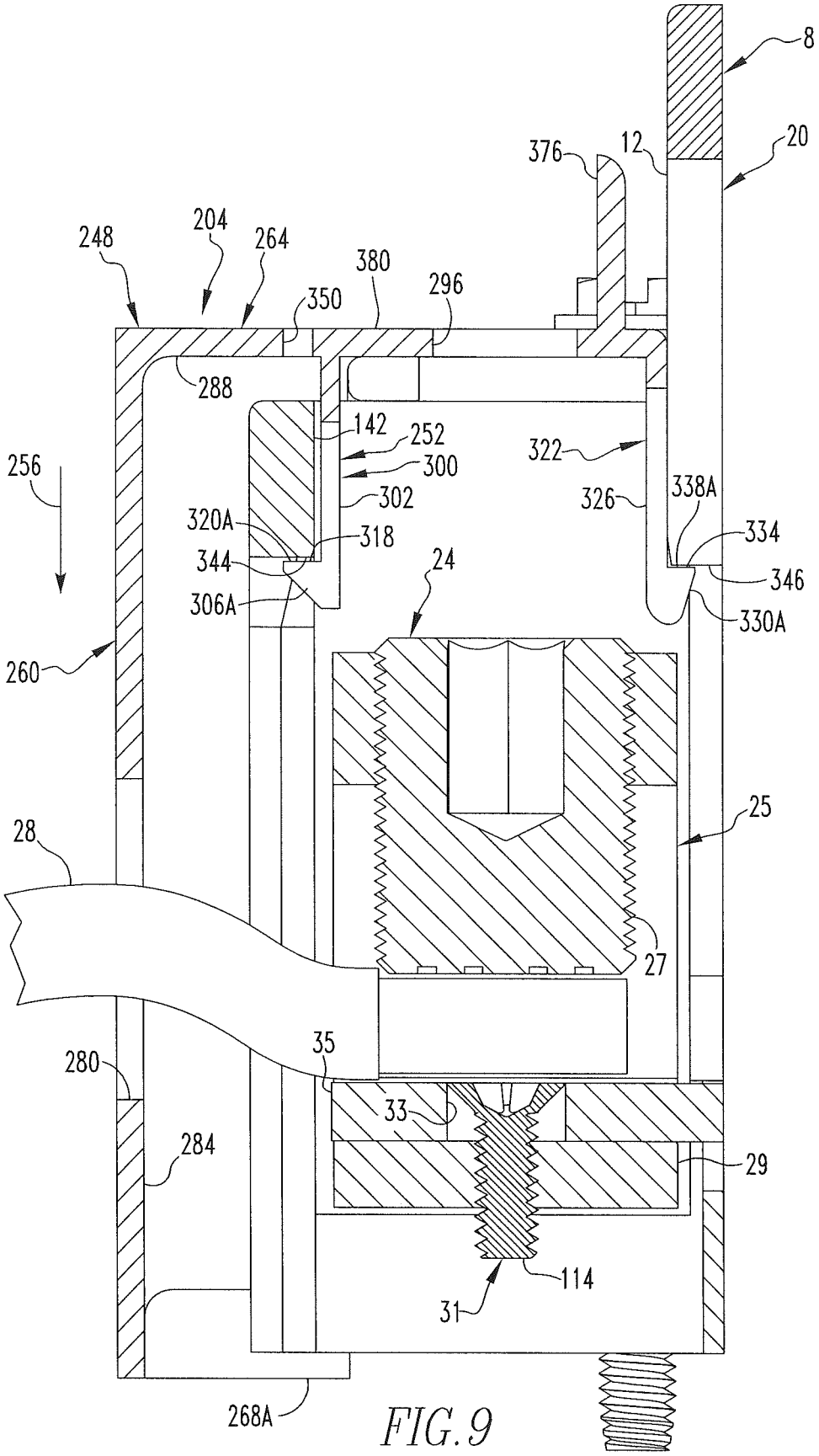
FIG. 9 is a sectional view as taken along line 9-9 of FIG. 8.

As can be understood from FIG. 9, the second pair of ledges 338A and 338B of each second attachment structure 322 are engaged with a lip 344 of the wall 142 when the barrier 204 is installed on the interruption device 8. In a similar fashion, the first pair of ledges 320A and 320B of each of the first attachment structures 300 are engaged with a corresponding engagement structure 346 that is formed on the housing 20 and which is depicted in FIG. 9. In this regard, it can be understood from FIG. 9 that the first pair of ledges 320A and 320B of each first attachment structure 300 protrude in a direction generally away from the tab 302 and that the second pair of ledges 338A and 338B protrude in another direction generally away from the tab 326, with the two directions being opposite one another. That is, the first pair of ledges 320A and 320B and the second pair of ledges 338A and 338B generally extend in directions away from one another, i.e., opposite one another, which helps in the securement of the cover 248 on the interruption device 8.

Figure 6:
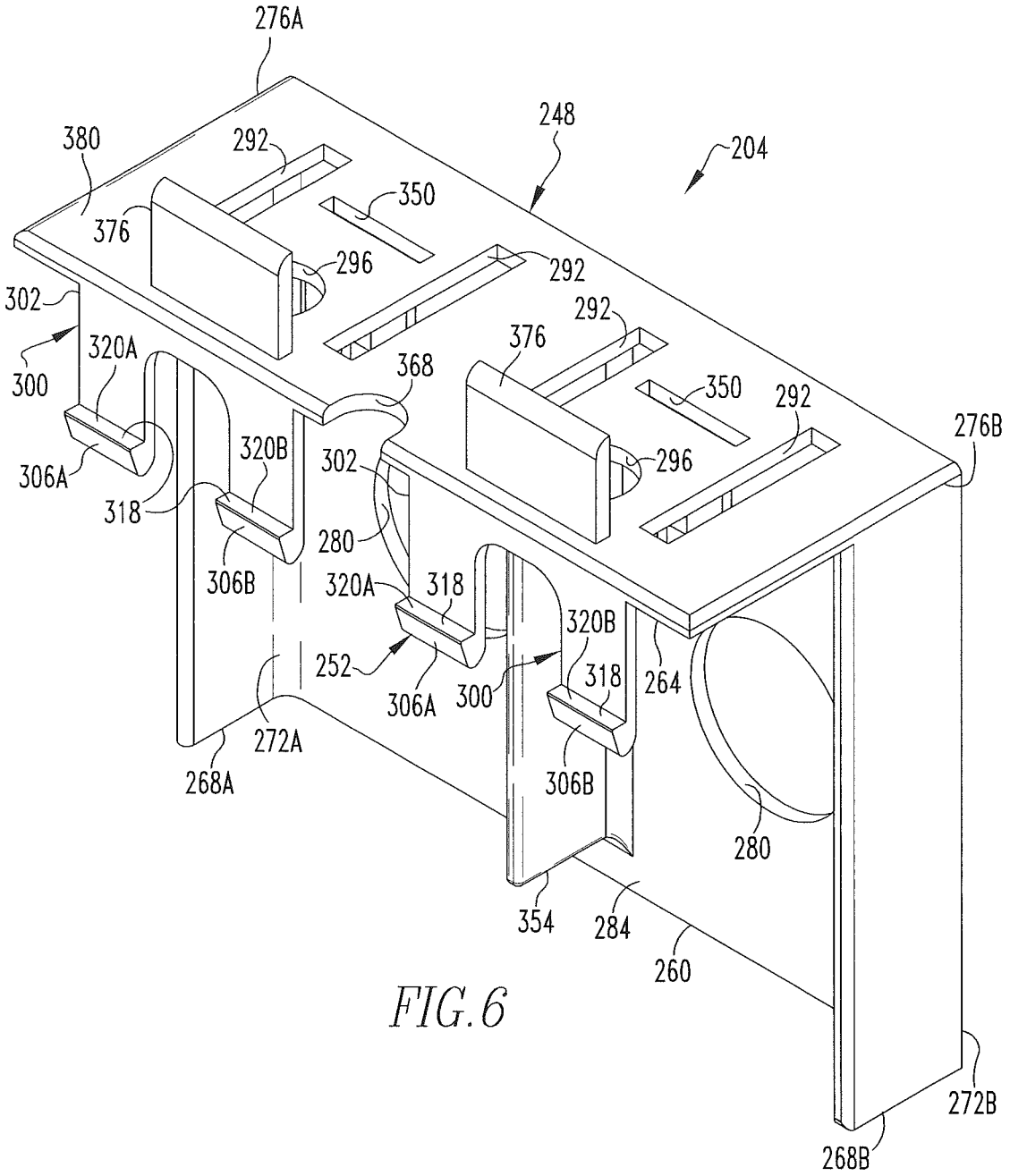
FIG. 6 is a perspective view of an improved barrier in accordance with a second embodiment of the disclosed and claimed concept.
Figure 7:
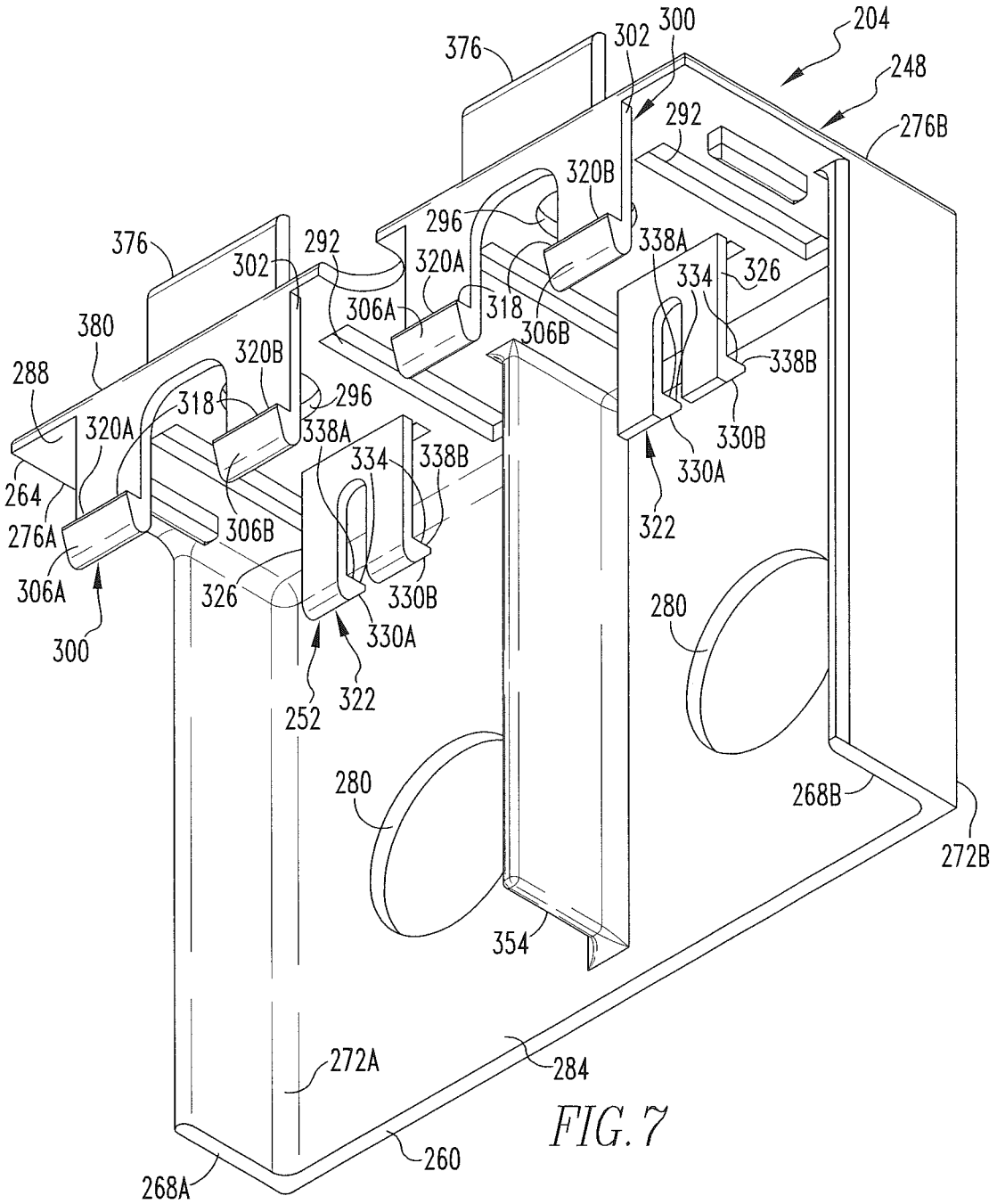
FIG. 7 is another perspective view of the second embodiment.
Figure 8:
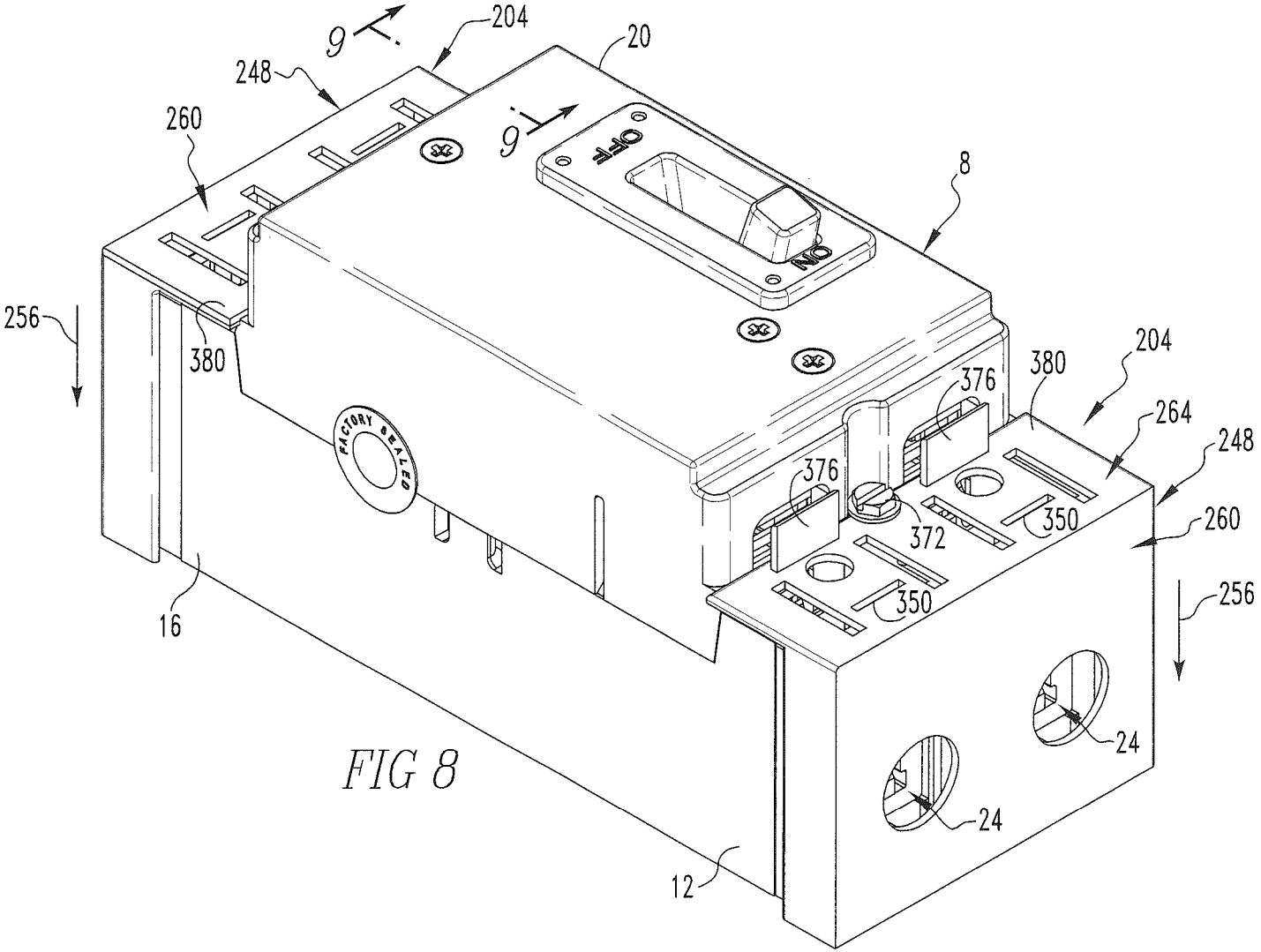
FIG. 8 is a perspective view depicting a pair of the barriers in accordance with the second embodiment installed on the electrical interruption device.

In order to remove the cover 248 from the interruption device 8, it can be seen from FIGS. 6 and 9 that a pair of receptacles 350 are formed in the second cover portion 264 and are configured to receive therein a removal tool such as a slot screwdriver or other appropriate tool for engagement with the second attachment structures 322 to elastically deform them to cause the second pairs of ledges 338A and 338B to clear the lip 344 to thus disengage the second attachment structures 322 from the housing 20. It can also be seen that the attachment apparatus 252 further includes a pair of lugs 376 that are situated on the exterior surface 380 substantially opposite the location on the second interior surface 288 from which the first attachment structures 300 protrude. The lugs 376 are manually engageable with a force in the rightward direction from the perspective of FIG. 9 to cause the first pair of ledges 320A and 328B of each first attachment structure 300 to become disengaged from the engagement structure 346 of the housing 20 to permit the first attachment structures 300 to become disengaged from the interruption device 8. Such disengagement of the first and second attachment structures 300 and 322 from the housing 20 permits the barrier 204 to be removed from the interruption device 8.

In a fashion similar to the barrier 4, the second cover portion 264 is formed with an indentation 368 that is cooperable with a screw 372 to more securely attach the barrier 204 to the load side 16 since the load side 16 is not configured to provide the engagement structure 346 on the load side 16. The use of the screw 372 thus provides a further securement of the barrier 204 to the housing 20 if the barrier 204 is optionally applied to the load side 16 of the interruption device 8.

Figure 10:
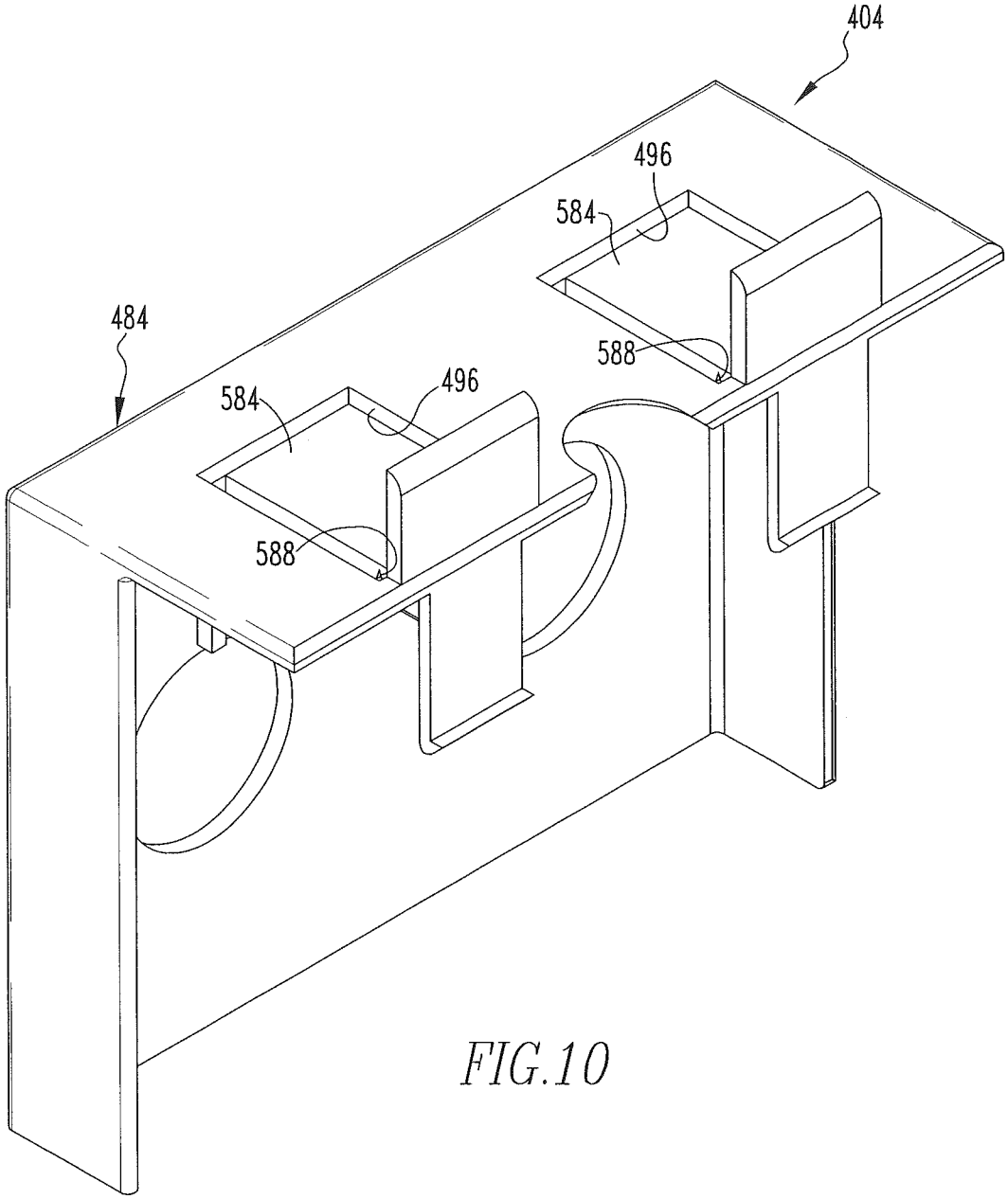
FIG. 10 is a perspective view of an improved barrier in accordance with a third embodiment of the disclosed and claimed concept.

An improved barrier 404 in accordance with a third embodiment of the disclosed and claimed concept is depicted generally in FIG. 10. The barrier 404 is depicted in a schematic and simplistic fashion to have similarities to the barrier 204, but the barrier 404 notably includes a pair of lids 584 situated across its access ports 496 to limit what can be received in the access ports 496 for connecting with the terminal assemblies 24. However, the lids 584 are connected by living hinges 588 with the cover 484 so that the living hinges 588 can be elastically deformed to permit the lids 584 to be pivoted out of the way sufficiently to permit access to the access ports 496 as appropriate, after which the lids 584 will elastically return to the original position that is depicted in FIG. 10. The lids 584 and the living hinges 588 can be incorporated into either the barrier 4 or the barrier 204 or both depending upon the needs of the particular application.

Figure 11:
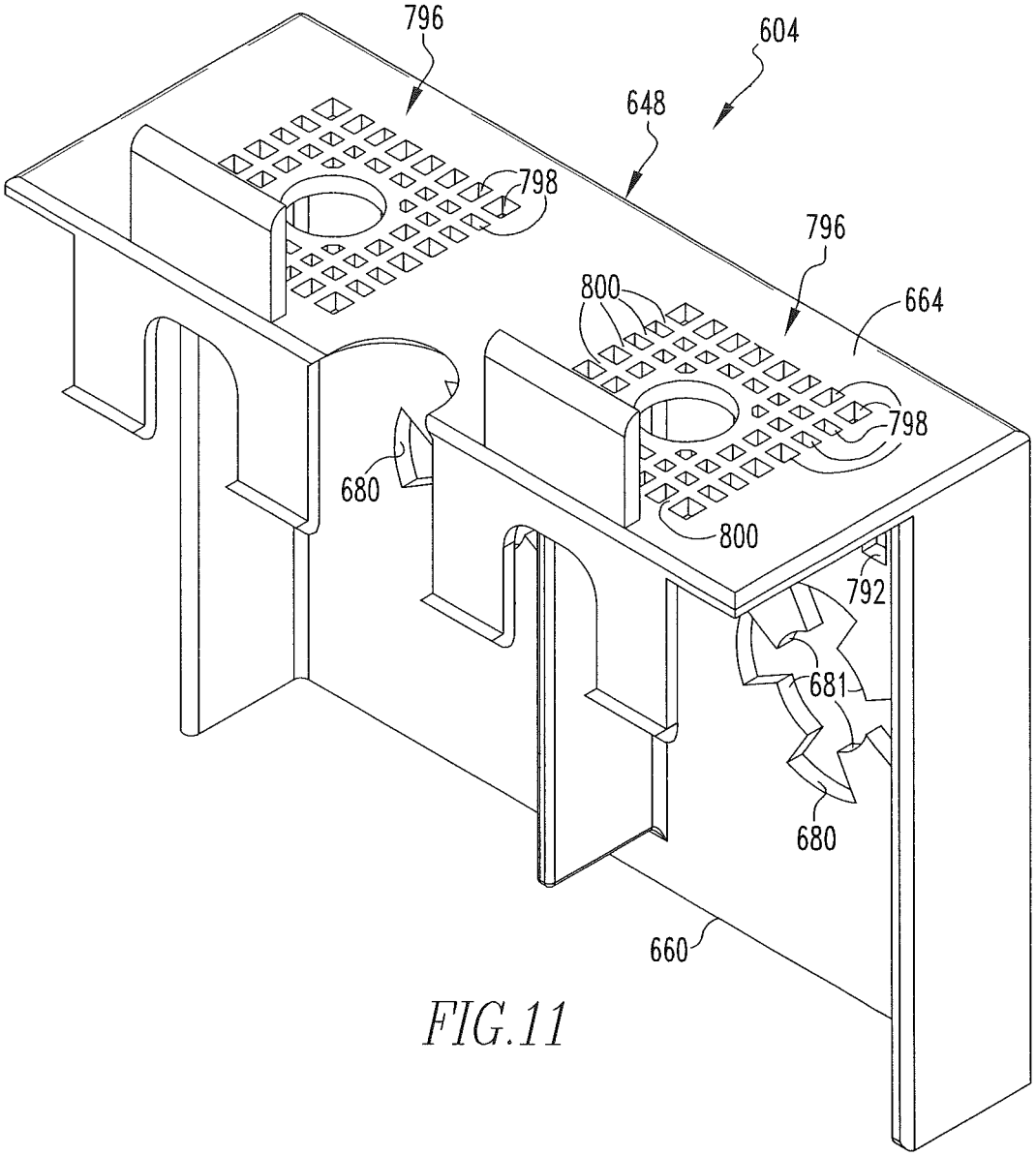
FIG. 11 is a perspective view of an improved barrier in accordance with a fourth embodiment of the disclosed and claimed concept.
Figure 12:
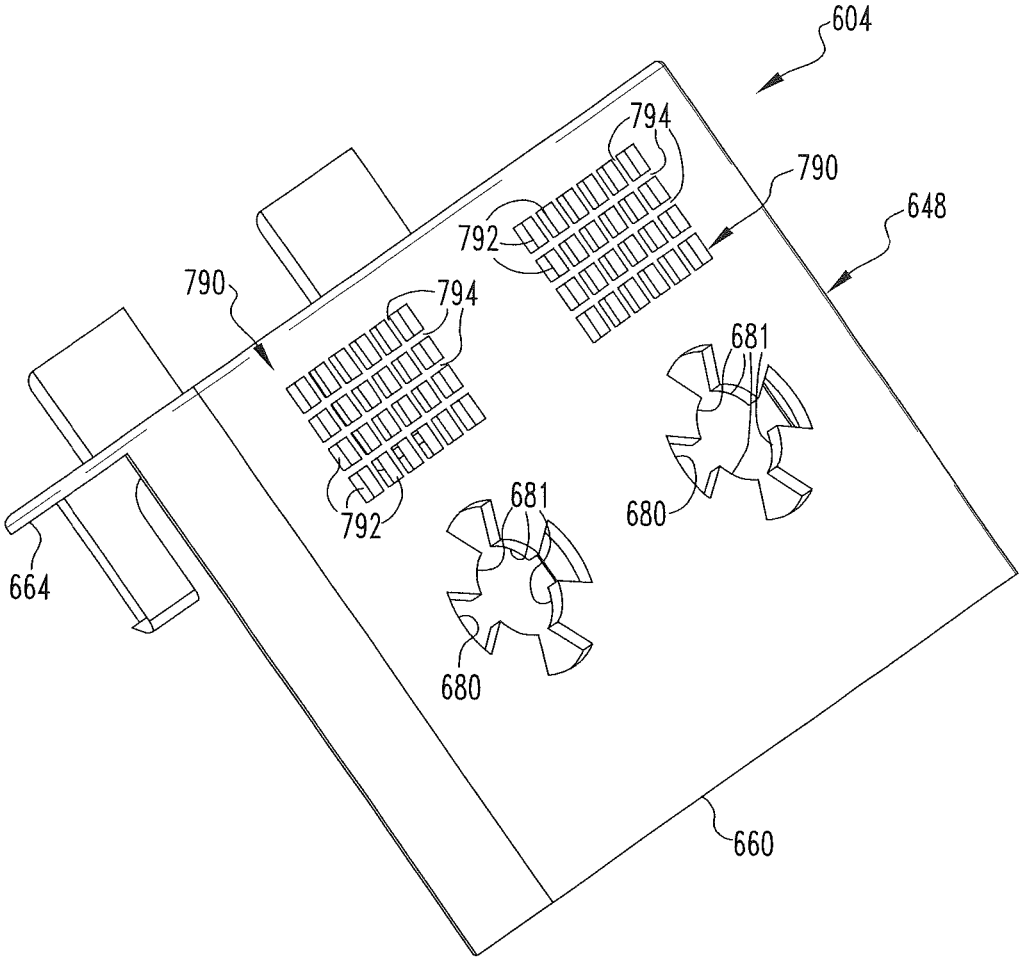
FIG. 12 is another perspective view of the fourth embodiment.

An improved barrier 604 in accordance with a fourth embodiment of the disclosed and claimed concept is depicted generally in FIGS. 11 and 12. The barrier 604 includes a cover 648 having a first cover portion 660 and a second cover portion 664. However, instead of having slot-like ventilation apertures being formed therein, the improved barrier 604 provides first and second grille regions 790 and 796 in the first and second cover portions 660 and 664, respectively, which provide relatively smaller apertures that provide more limited access while providing enhanced air flow therethrough.

More specifically, the first grille regions 790 include a plurality of first apertures 792 that are separated by first cross members 794 to provide a plurality of relatively small air flow regions, but that provide a large number of the first apertures 792 so that improved air flow can be provided. Likewise, the second grille regions 796 include a large number of second apertures 798 formed therein that are situated adjacent second cross members 800 that separate the second apertures 798 from one another. The first and second cross members 794 and 800 thus cause the first and second apertures 792 and 798, respectively, to be relatively smaller than the ventilation apertures provided at the numerals 92 and 292 in the barriers 4 and 204, respectively, which is desirable because it further limits access to the live components of the interruption device 8. However, by providing a relatively larger region of air flow area due to the large number of first and second apertures 794 and 800, improved ventilation is provided. The first and second grow regions 790 and 796 can be implemented into the barrier 4 or the barrier 204 or both.

It can also be seen that the barrier 604 has a set of openings 680 formed therein that are structured to receive therethrough the line conductors 28. Each opening 680 has a number of deformable protrusions 681 situated therein that are deformable to enable the reception of line conducts 28 of various appropriate sizes in the openings 680 but that resist entry of the probe 32 in the openings 680 when the line conductors 28 are received therein. The protrusions 681 can be implemented into any of the barriers 4, 204, and 404, by way of example. Other variations will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A barrier that is structured to be used with an electrical interruption device having a housing and further having a number of terminal assemblies that are situated on the housing, the number of terminal assemblies being electrically conductive and being electrically connected with a number of line conductors, the barrier being structured to resist access to the number of terminal assemblies by a probe of predetermined dimensions, the barrier comprising:

a cover comprising a first cover portion and a second cover portion connected together, the cover being structured to limit access by the probe to the number of terminal assemblies;

the first cover portion being plate-like and having a number of openings formed therein that are structured to receive therein the number of line conductors;

the second cover portion being plate-like and being structured to overlie the number of terminal assemblies and having formed therein a number of access ports that are structured to receive therein a tool that is cooperable with the number of terminal assemblies to facilitate connection and disconnection of the number of line conductors;

the cover further comprising a pair of lateral cover portions, each of which is plate-like and is situated on an edge of at least one of the first cover portion and the second cover portion and that extends from and along the edge to another edge of the other of the first cover portion and the second cover portion;

an attachment apparatus comprising a number of attachment structures that are situated on the cover and that are each structured to be engaged with at least one of the housing and at least a first terminal assembly of the number of terminal assemblies to retain the barrier on the electrical interruption device; and wherein the pair of lateral cover portions each extend along the edge to a location situated adjacent the another edge but are each disconnected from the other of the first cover portion and the second cover portion at the location.

2. The barrier of claim 1 wherein the number of attachment structures comprise an attachment structure having a tab situated on the cover and a retainer that is situated on the tab at a location thereon spaced from the cover and that is structured to be engaged with at least one of the housing and the at least first terminal assembly to retain the barrier on the electrical interruption device.

3. The barrier of claim 1 wherein the cover has formed therein a number of ventilation apertures that are structured to permit convective air flow therethrough to facilitate convective cooling.

4. The barrier of claim 1 wherein the cover further comprises a number of alignment structures that are situated on a surface of the cover that is structured to face generally toward the electrical interruption device, at least a first alignment structure of the number of alignment structures being structured to be received in a first direction into a notch formed in the housing.

5. The barrier of claim 1 wherein the number of attachment structures comprise a first attachment structure and a second attachment structure, the first attachment structure having a first retainer and a first ramped insertion surface, the second attachment structure having a second retainer and a second ramped insertion surface, the first and second ramped insertion surfaces being structured to engage the electrical interruption device during installation of the barrier on the electrical interruption device to facilitate engagement of the first and second retainers with the at least one of the housing and the at least first terminal assembly.

6. The barrier of claim 5 wherein the first retainer is a first ledge that is structured to be engaged with the at least one of the housing and the at least first terminal assembly, and wherein the second retainer is a second ledge that is structured to be engaged with the at least one of the housing and the at least first terminal assembly.

7. The barrier of claim 6 wherein at least one of:

the first ledge is situated adjacent the first ramped insertion surface; and the second ledge is situated adjacent the second ramped insertion surface.

8. The barrier of claim 6 wherein one of the first attachment structure and the second attachment structure is an elongated tab that is situated on and extends away from one of the first cover portion and the second cover portion and has formed therein a hole, a portion of the tab adjacent the hole being at least one of the first retainer and the second retainer.

9. The barrier of claim 6 wherein the first attachment structure is situated on the first cover portion, and wherein the second attachment structure is situated on the second cover portion, and wherein the first and second ledges together face generally toward one of the first cover portion and the second cover portion.

10. The barrier of claim 9 wherein the second cover portion is oriented substantially perpendicular to the first cover portion.

11. A barrier that is structured to be used with an electrical interruption device having a housing and further having a number of terminal assemblies that are situated on the housing, the number of terminal assemblies being electrically conductive and being electrically connected with a number of line conductors, the barrier being structured to resist access to the number of terminal assemblies by a probe of predetermined dimensions, the barrier comprising:

a cover comprising a first cover portion and a second cover portion connected together, the cover being structured to limit access by the probe to the number of terminal assemblies;

the first cover portion being plate-like and having a number of openings formed therein that are structured to receive therein the number of line conductors;

the second cover portion being plate-like and being structured to overlie the number of terminal assemblies and having formed therein a number of access ports that are structured to receive therein a tool that is cooperable with the number of terminal assemblies to facilitate connection and disconnection of the number of line conductors;

the cover further comprising a pair of lateral cover portions, each of which is plate-like and is situated on an edge of at least one of the first cover portion and the second cover portion and that extends from and along the edge to another edge of the other of the first cover portion and the second cover portion;

an attachment apparatus comprising a number of attachment structures that are situated on the cover and that are each structured to be engaged with at least one of the housing and at least a first terminal assembly of the number of terminal assemblies to retain the barrier on the electrical interruption device;

wherein the number of attachment structures comprise a first attachment structure and a second attachment structure, the first attachment structure having a first retainer and a first ramped insertion surface, the second attachment structure having a second retainer and a second ramped insertion surface, the first and second ramped insertion surfaces being structured to engage the electrical interruption device during installation of the barrier on the electrical interruption device to facilitate engagement of the first and second retainers with the at least one of the housing and the at least first terminal assembly;

wherein the first retainer is a first ledge that is structured to be engaged with the at least one of the housing and the at least first terminal assembly, and wherein the second retainer is a second ledge that is structured to be engaged with the at least one of the housing and the at least first terminal assembly;

wherein the first attachment structure is situated on the first cover portion, and wherein the second attachment structure is situated on the second cover portion, and wherein the first and second ledges together face generally toward one of the first cover portion and the second cover portion;

wherein the second cover portion is oriented substantially perpendicular to the first cover portion; and wherein the pair of lateral cover portions each extend along the edge to a location situated adjacent the another edge but are each disconnected from the other of the first cover portion and the second cover portion at the location.

12. The barrier of claim 11 wherein the pair of lateral cover portions are each oriented substantially parallel with one another while being oriented substantially perpendicular to the first and second cover portions.

* * * * *